United States Patent [19]

Ingram

[11] Patent Number: 4,527,713

[45] Date of Patent: Jul. 9, 1985

[54] COIN OPERATED FRAGRANCE DISPENSER

[75] Inventor: James L. Ingram, Pine Bluff, Ark.

[73] Assignee: Car Fresh Manufacturing Company, Inc., Pine Bluff, Ark.

[21] Appl. No.: 620,392

[22] Filed: Jun. 13, 1984

[51] Int. Cl.[3] ..... G07F 13/08

[52] U.S. Cl. ..... 222/2; 222/136

[58] Field of Search ..... 222/2, 136; 194/9 T, 194/3, 13; 239/305, 306, 307

[56] References Cited

U.S. PATENT DOCUMENTS 3,387,692 6/1968 Levake ..... 194/13 X

*Primary Examiner*—Stanley H. Tollberg

*Attorney, Agent, or Firm*—Stephen D. Carver

[57] ABSTRACT

A coin operated dispenser for spraying desired fragrances interiorly of an automobile or vehicle. Preferably the dispenser includes a generally cubical, rigid, cabinet adapted to be mounted to a rigid support. Containers of fragrances to be dispensed are disposed within the cabinet. A compressor delivers air pressure to a coin operated control system for selectively outputting desired fragrances through a remote manually actuable spray gun. Customers are attracted by a visually pleasing display module associated with the cabinet. The module includes a rigid enclosure having a top, a bottom, and a translucent front permitting the visual inspection of its interior. Preferably a pair of cylindrical containment compartments disposed within the enclosure extend between the top and bottom thereof. Each containment compartment includes a bottom mounted, preferably cylindrical fluid control compartment and a top mounted cylindrical fluid control compartment. Vents are provided to establish fluid flow communication between the fluid control compartments and the interior of the containment compartment. An elongated tubular passageway extends between the first and second fluid control compartments. A viscous display oil disposed within the containment compartment may be pumped from the interior of the first fluid control compartment up through the passageway into the interior of the second fluid control compartment creating a visually appealing bubbling effect. Bubbling fluid reaching the upper fluid control compartment will drop downwardly through the vents provided in same to be subsequently recycled.

4 Claims, 8 Drawing Figures

COIN OPERATED FRAGRANCE DISPENSER

BACKGROUND OF THE INVENTION

The present invention relates generally to coin operated devices for spraying fragrances or the like interiorly of vehicles. More particularly, the present invention relates to a coin operated fragrance dispenser which includes an aesthetically pleasing and functional display module for attracting customers.

In the prior art it is known to provide a coin operated system for dispensing fragrances. Typical systems include some form of pneumatic pressure source such as a pump or compressor for driving stored liquid through a remote applicator gun. The output from the gun comprises a mist which may be applied by the consumer to various portions of the car interior, preferably the underside of seats or the like. Such systems are usually employed as an adjunct to coin operated or "self service" car wash systems, but they may be employed in conjunction with any type of vehicle washing installation. Typical car wash installations have the usual bay into which the vehicle to be washed may be moved, and a variety of associated high pressure applicator hoses for washing, rinsing, and waxing. A variety of other existing apparatus enables the consumer to thereafter detail the automobile by thoroughly cleaning and treating the vehicle interior. For example, a vacuum extraction cleaning machine which may be employed at typical coin operated car installations is disclosed in U.S. Pat. No. 4,194,262, issued Mar. 25, 1980. The latter device enables the consumer to shampoo the interior of his vehicle. My device relates to a system for additionally dispensing a fragrance within the interior of the vehicle to deodorize same and to provide a fresh, attractive smelling interior.

In the coin operated vending arts it is also known that some form of aesthetically pleasing customer attracting display will produce more revenue for the operator. Hence a variety of display systems have been proposed. In one prior art system known to me a translucent, plastic cylinder includes a limited quantity of colored fluid which, in combination with suitable lighting, provides a visually attractive sight for potential customers. The most relevant art known to me in this regard comprises United States design patent U.S. Pat. No. 252,295 issued July 3, 1979 for a bubble display device. The latter art teaches the desirability of providing a display through transparent columns filled with suitably colored liquids. A related display stand is seen in United States Design patents U.S. Pat. Nos. 229,451 issued Nov. 27, 1973, and 244,368 issued May 17, 1977. United States utility patents U.S. Pat. Nos. 2,453,178 and 3,531,635 also broadly illustrate the use of columns of fluid for display and attract purposes. Of lesser relevance is United Kingdom Pat. No. 1,110,109.

SUMMARY OF THE INVENTION

The present invention comprises a coin operated dispensing device which attracts customers with a unique, visually attractive display module.

A rigid, preferably metallic, generally cubicle cabinet is adapted to be supported upon a rigid supporting surface, or it may be mounted upon a suitable upright stanchion. Preferably the device is installed within an area or region which is easily accessible to a customer vehicle. The cabinet houses the working parts of the device, including a pneumatic compressor and suitable electrical, pneumatic and fluid control apparatus. A plurality of replaceable containers of selectable fragrance concentrate are disposed within the cabinet and the pneumatic pumping system is adapted to draw fragrance from the containers through the apparatus and out through an applicator gun in the form of a mist. Actuation of the device is commenced upon insertion of an appropriate value of coins through a coin acceptance unit of conventional construction, which immediately triggers a conventional timer.

A unique customer display module is associated with the apparatus. The module comprises a rigid enclosure preferably formed of a translucent plastic which is mounted to the cabinet access door. The translucent front side of the module enables the module interior to be visually apparent to a potential customer. At least one preferably translucent, cylindrical plastic, containment compartment is disposed within the module. The containment compartment extends between and is sealed to the top and bottom of the module enclosure and is at least partially filled with visually attractive, colored viscous working fluid. A first generally cylindrical, preferably plastic fluid control compartment is disposed at the bottom of the containment compartment. A second fluid control compartment in spaced apart relation relative to the first fluid control compartment is mounted within the containment compartment, preferably at the top thereof. In the best mode known to me both fluid control compartments are of similar generally cylindrical geometry, and both are substantially smaller than the containment compartment. Also, both fluid control compartments are preferably comprised of translucent plastic, and each of them is mounted coaxially with respect to the containment compartment.

Fluid flow vents defined in the upper and lower fluid control compartments enable fluid to be exchanged between them and the containment compartment interior. Additionally, an elongated preferably cylindrical central passageway extends from the top of the first fluid control compartment upwardly to the bottom of the second fluid control compartment to establish fluid flow communication therebetween. Preferably the central passageway is established by a relatively small diameter, cylindrical tube which is comprised of translucent plastic and which is disposed at the center of the containment compartment in coaxial, centered relationship therewith. A pneumatic input pressure passageway enables air to be forced from an aquarium pump housed within the cabinet to the interior of the first fluid control compartment at the top of the containment compartment.

Prior to pressurization of the lower fluid control compartment the display fluid within the containment compartment will seek a uniform level. However, once the aquarium pump is actuated pneumatic pressure transmitted through the input pressure passageway will create a pressure head at the top of the first fluid control compartment, and as a result high pressure air will force the colored display fluid disposed therewithin upwardly through the central passageway into the interior of the second fluid control compartment. Fluid will thus bubble upwardly into the second fluid control compartment, and thereafter fluid will be recycled by dropping through the second control compartment vents downwardly through the interior of the containment compartment about the periphery of the encircled central tubular passageway. Fluid thus returned to the bottom of the containment compartment will reenter the first containment compartment through vents provided in the bottom.

Preferably the working fluid comprises a low vapor pressure oil having a viscosity of approximately SAE 1W to 5W. Also, the freezing point of the working fluid should be quite low. The colorful and visually fascinating effects generated by recirculation of fluid of the character described within and through the aforementioned compartments has been found to be quite attractive to potential customers, whose natural curiosity may thus be stimulated.

Thus a broad object of the present invention is to provide a fragrance dispenser and applicator device for vehicles.

More particularly, it is an object of the present invention to provide a coin operated fragrance dispenser device of the character described, equipped with a visually pleasing display.

It is another object of the present invention to provide a module for generating visually pleasing bubbling effects.

Similarly it is an object of the present invention to provide a module of the character described which may be employed in conjunction with a variety of coin operated applicator systems.

A still further object of the present invention is to provide a coin operated fragrance dispenser of the character described which will power its associated display apparatus with the same pneumatic signal generated for providing the output mist.

A similar object of the present invention is to provide a display module of the character described in association with a coin operated fragrance dispenser in an integrated unit.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
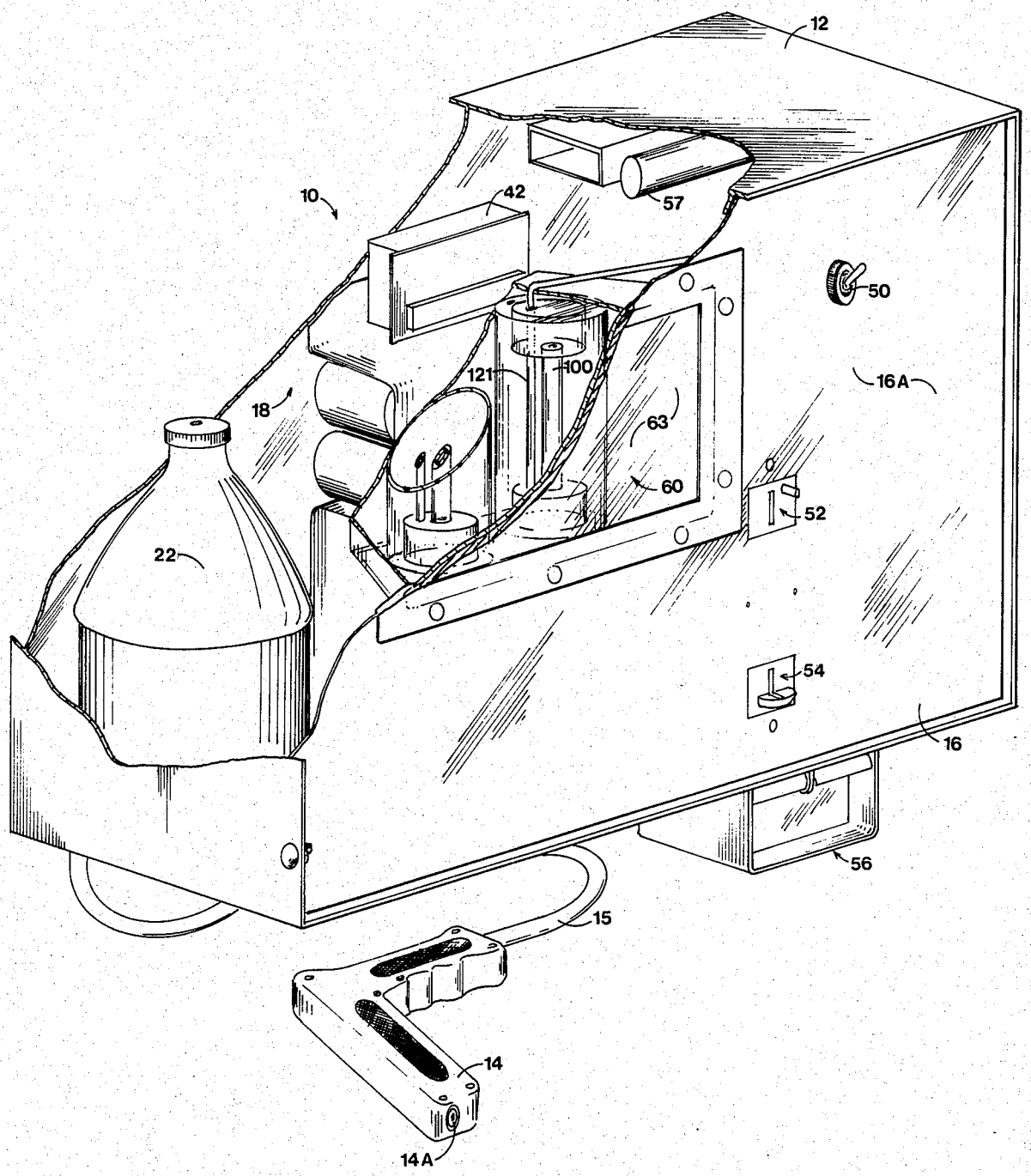
FIG. 1 is a fragmentary, isometric view of the dispenser constructed in accordance with the teachings of the present invention.

With initial reference now directed to FIG. 1, of the appended drawings, a coin operated fragrance dispenser constructed in accordance with the preferred teachings of the present invention has been generally designated by the reference numeral 10. Dispenser 10 comprises a rigid generally cubicle cabinet, generally designated by the reference numeral 12, which contains a variety of internal components for generating and outputting a fine mist of fragrance, deodorant or the like from a remotely disposed hand held applicator gun 14. Fragrance is pneumatically supplied to gun 14 via applicator line 15. The cabinet 12 includes a front door 16 having a front surface 16A facing the consumer. The cabinet interior 18 provides room for a variety of components, such as bottles 22, 24 (FIG. 3) which contain a predetermined quantity of fragrance solution to be dispensed.

Figure 2:
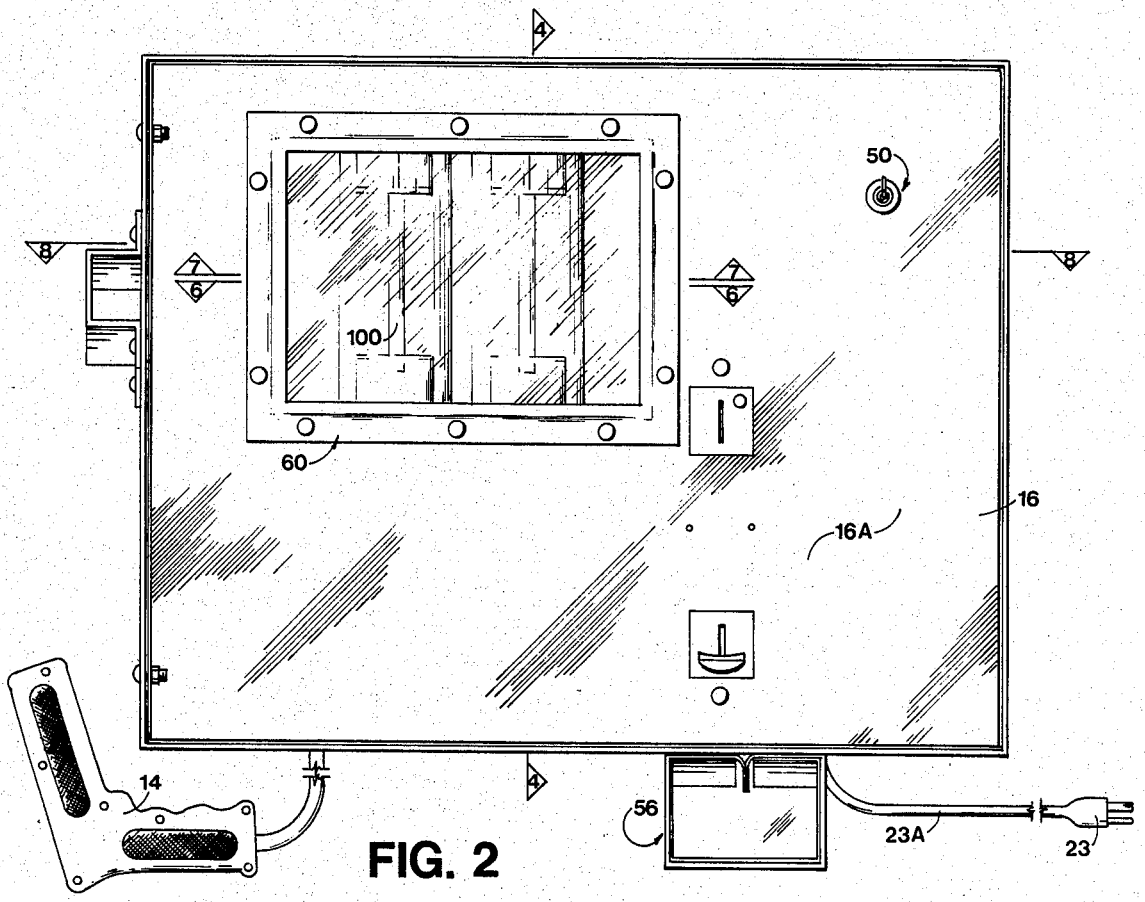
FIG. 2 is a front plan view thereof.
Figure 3:
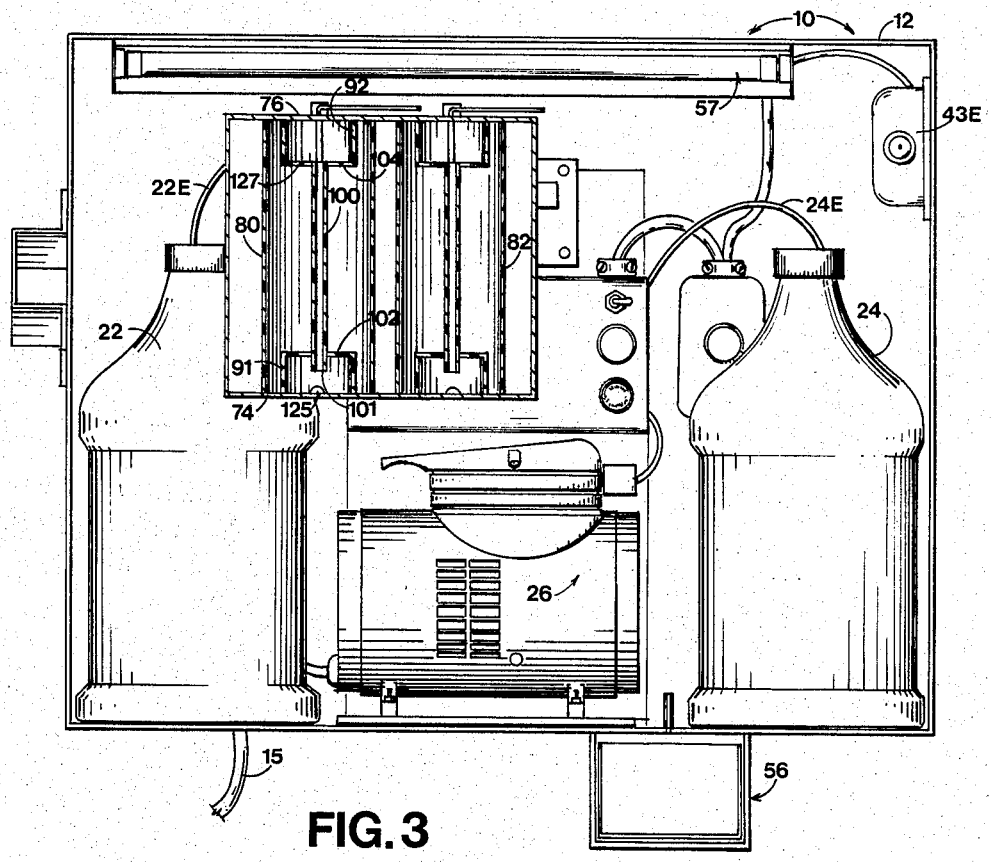
FIG. 3 is a sectional view of the apparatus with the front door removed, and with portions thereof broken away for clarity.
Figure 4:
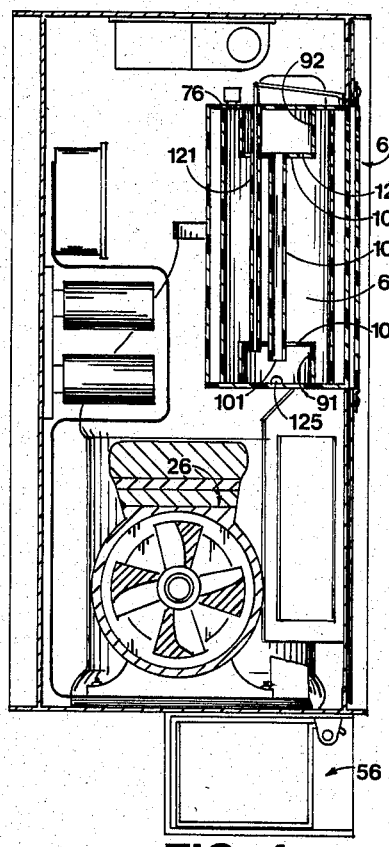
FIG. 4 is a side sectional view thereof, taken along line 4—4 of FIG. 2 in the direction of the arrows.
Figure 5:
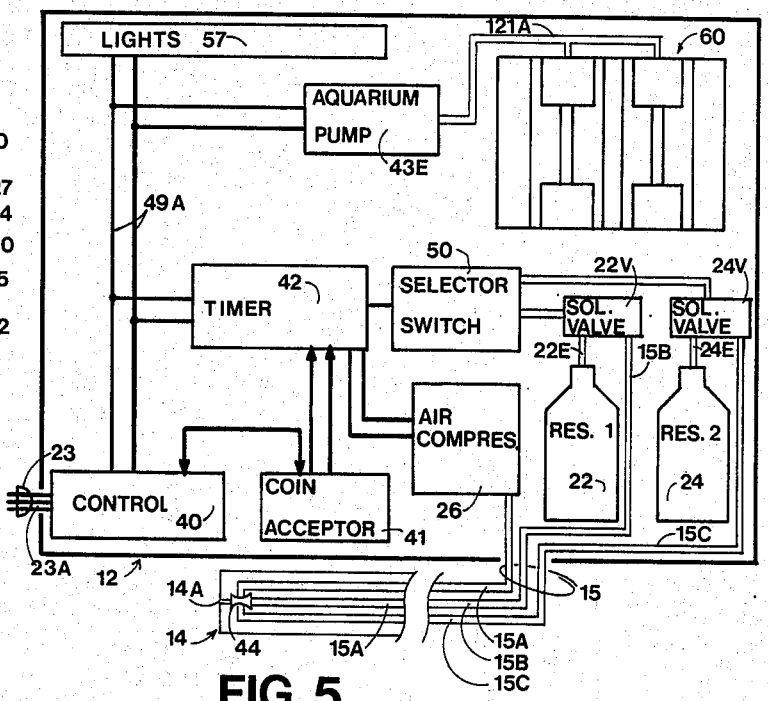
FIG. 5 is an operational schematic and block diagram of the apparatus.
Figure 6:
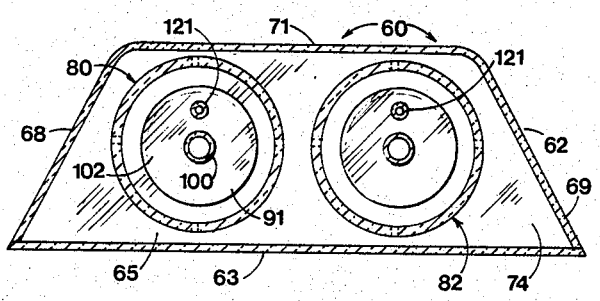
FIG. 6 is an enlarged sectional view taken generally along line 6—6 of FIG. 4.
Figure 7:
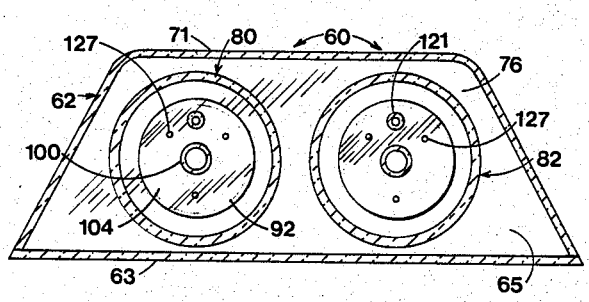
FIG. 7 is an enlarged sectional view taken generally along line 7—7 of FIG. 4 in the direction of the arrows; and, FIG. 8 is a sectional view taken generally along line 8—8 of FIG. 4 in the direction of the arrows.
Figure 8:
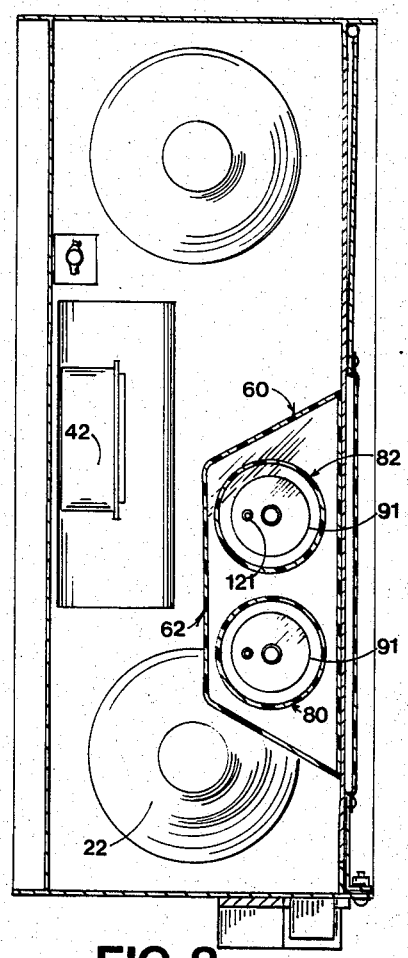

With additional reference now directed to FIGS. 2, 3 and 5, power is delivered to cabinet 12 via conventional plug 23 and line 23A, which terminates at a control bus 40. When coin acceptor 41 is actuated by the input of a suitable, selectable value of coins, timer 42 will be cycled and compressor 26 will operate for a predetermined amount of time. Gun line 15 actually comprises a bundle of three separate tubular fluid conduits 15A, 15B, and 15C. High pressure air is delivered to gun valve 44 via line 15A, creating suction upon fragrance lines 15B and 15C. The customer-actuated selector switch 50 selects a solenoid valve 22V or 24V to draw fragrance from bottles 22 or 24 respectively. If, for example, valve 22V is selected, fragrance within container 22 will be drawn up through line 22E, through valve 22V and out through line 15B to gun valve 44. Valve 24V permits fragrance from container 24 to be drawn out through suction appearing on line 24E. A pair of fragrance lines 15B, 15C are desired so that contamination between fragrances will be avoided. The conventional coin acceptor mechanism 41 initiates operation of the apparatus providing that a suitable value of coins is deposited through input slot assembly 52. Change is returned through outlet 54. Coin box 56 stores accumulated coins.

Preferably a lighting system comprising a fluorescent light 57 is disposed within cabinet 12 to illuminate the interior 18 thereof. Lighting is concurrent with operation of the aquarium pump 43E (FIG. 5) which provides operational air pressure to the display system to be hereinafter described.

With reference now to FIGS. 2 and 4 through 8, the dispenser 10 is equipped with a display module generally designated by the reference numeral 60. As best revealed in FIGS. 6 and 7 the display module 60 comprises a rigid, preferably plastic enclosure generally designated by the reference numeral 62, which is of generally trapezoidal cross section. Preferably the enclosure front 63 is comprised of translucent plastic permitting visual inspection of the interior 65 of the display module 60. However, the sides 68, 69 and the rear 71 are preferably comprised of opaque plastic. Bottom 74 is preferably opaque while top 76 is preferably translucent.

The display module 60 preferably comprises a pair of spaced apart containment compartments which have generally been designated by the reference numerals 80 and 82. Both of these containment compartments are identical, and are preferably comprised of translucent plastic. Essentially each containment compartment comprises an elongated cylinder which extends between the bottom 74 and the top 76 of the enclosure 62. Since the containment vessels 80, 82 will be filled with a display fluid 88 (FIG. 3), and since pneumatic pressure will be transmitted to the display apparatus, it is very important that a seal be established through glue or the like at the end of each containment cylinder 80 or 82.

Each containment compartment 80, 82 includes a lower, preferably translucent, cylindrical first fluid control compartment 91 and a second, top-mounted fluid control compartment 92, both of which are disposed concentrically interiorly of the containment compartment 80. Preferably compartment 92 is disposed in contact with the top 76 of the enclosure 62 and compartment 91 is secured in contact with enclosure bottom 74.

An elongated, central tubular pipe of reduced diameter, generally designated by the reference numeral 100, establishes fluid flow communication between fluid control compartments 91 and 92. Pipe 100 extends between the top 102 (FIG. 6) of the first fluid control compartment 91 and the bottom 104 (FIG. 7) of the second fluid control compartment 92. The lowermost portion 101 of the pipe 100 extends downwardly into compartment 91 substantially below the top 102 thereof. The lower fluid control compartment 91 is pressurized by an elongated pneumatic input pipe 121 which extends from the top 76 of the enclosure 62 through top 102. Vents 125 defined in the lower portions of compartment 91 establish fluid flow communication between the interior of compartment 91 and the surrounding interior volume of the containment compartment 80. Vents 127 defined in the bottom 104 of the upper fluid control compartment 92 enable fluid reaching the latter compartment through pipe 100 to thereafter drop downwardly into the interior of the containment compartment 80.

Once pneumatic pressure is applied to input tube 121, via line 121A from aquarium pump 43E (FIG. 5), a pressure head of air will be developed within lower compartment 91 against a head of display fluid whose level will be substantially flush against the lower end 101 of pipe 100. At this time display fluid will be forced through pipe 100 up into the interior of compartment 92, from which it may thereafter drop down through the interior of containment compartment 80 via exhaust vents 127 defined in the bottom 104 of compartment 92. Meanwhile light generated from system 57 previously discussed will illuminate the entire display apparatus and the bubbling activities within display module will be readily apparent to potential customers.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A coin operated fragrance dispenser for deodorizing and freshening automobiles, trucks and vehicles, said dispenser comprising:

a rigid generally cubical cabinet adapted to be secured to a supporting structure or surface;

reservoir means disposed within said cabinet for providing at least one source of fragrance to be dispensed;

pressure means for establishing a source of air pressure for dispensing fragrance;

hand applicator means responsive to said pressure means for dispensing a fragrance;

coin acceptance means for actuating said pressure means in response to the input of a suitable money value of coins by a consumer; and;

a display module for visually attracting customers, the display module comprising:

a rigid enclosure having a top, a bottom, an interior and a translucent front permitting the visual inspection of said enclosure interior;

at least one translucent, sealed containment compartment disposed within said enclosure and extending between said enclosure top and said enclosure bottom, said containment compartment having an interior;

a first fluid control compartment disposed within said containment compartment upon the bottom of said enclosure;

first vent means for establishing fluid flow passage between said first fluid control compartment and the interior of said containment compartment;

a second fluid control compartment disposed within said containment compartment interior and spaced apart from said first fluid control compartment;

second vent means for establishing fluid flow passage between said second fluid control compartment and said interior of said containment compartment;

elongated, tubular passageway means extending in fluid flow communication interiorly of said containment compartment between said first and second fluid control compartments;

a viscous fluid disposed within said containment compartment; and, pneumatic passageway means extending interiorly of said first fluid control compartment for inputting air into said first fluid control compartment for pneumatically pressurizing same to circulate said viscous fluid between said first and second fluid control compartments.

2. The fragrance dispenser as defined in claim 1 wherein said containment compartment, and said first and second fluid control compartments are cylindrical, and are all comprised of translucent plastic, said first and second fluid control compartments being disposed within said translucent containment compartment in coaxial relationship therewithin.

3. The fragrance dispenser as defined in claim 2 wherein said elongated tubular passageway means comprises an elongated, tubular translucent plastic pipe having a diameter substantially less than the diameter of either said first fluid control compartment or said second fluid control compartment and oriented vertically coaxially within said containment compartment.

4. The fragrance dispenser as defined in claim 3 including fragrance selector means for selecting a desired fragrance to be outputted.

* * * * *